US010344444B2

(12) United States Patent
Durkin et al.

(10) Patent No.: US 10,344,444 B2
(45) Date of Patent: Jul. 9, 2019

(54) EDGE PROTECTION SAFETY BUND SYSTEM

(71) Applicant: Hiram (WA) Pty Ltd, Forrestfield, Western Australia (AU)

(72) Inventors: Steven Peter Durkin, Forrestfield (AU); John Forbes Murdoch, Forrestfield (AU)

(73) Assignee: Hiram (WA) Pty Ltd, Forrestfield (AU)

( * ) Notice: Subject to any disclaimer, the term of this patent is extended or adjusted under 35 U.S.C. 154(b) by 0 days.

(21) Appl. No.: 15/321,926

(22) PCT Filed: Jun. 30, 2015

(86) PCT No.: PCT/AU2015/000378
§ 371 (c)(1),
(2) Date: Dec. 23, 2016

(87) PCT Pub. No.: WO2016/025974
PCT Pub. Date: Feb. 25, 2016

(65) Prior Publication Data

US 2017/0130417 A1 May 11, 2017

(30) Foreign Application Priority Data

Aug. 18, 2014 (AU) ..... 2014903228

(51) Int. Cl.
*E02D 17/18* (2006.01)
*E02D 29/02* (2006.01)
*E02D 17/08* (2006.01)

(52) U.S. Cl.
CPC ..... *E02D 29/0225* (2013.01); *E02D 17/08* (2013.01); *E02D 29/0266* (2013.01);
(Continued)

(58) Field of Classification Search
CPC . E02D 29/0225; E02D 29/0266; E02D 17/08; E02D 2200/1642; E02D 2220/00;
(Continued)

(56) References Cited

U.S. PATENT DOCUMENTS 952,645 A * 3/1910 Smith ..... E02D 29/0266 405/285
2,515,059 A * 7/1950 Rowbotham ..... E02B 3/102 405/110
(Continued)

FOREIGN PATENT DOCUMENTS

GB 2 364 729 2/2002
JP 2002-339364 11/2002
(Continued)

OTHER PUBLICATIONS

Written Opinion and International Search Report issued in International Application No. PCT/AU2015/000378, dated Jul. 27, 2015, 9 pages.
(Continued)

*Primary Examiner* — Carib A Oquendo
(74) *Attorney, Agent, or Firm* — Hamre, Schumann, Mueller & Larson, P.C.

(57) ABSTRACT

An edge protection safety bund system (10) for use in connection with a rock bund made of rock fill. The edge protection safety bund system (10) comprises a bund module (12) having a barrier wall (14) and a base plate (16). The bund module (12) is preferably one of a plurality of bund modules (12) arranged side by side to form an extended barrier wall (14). The barrier wall (14) of each module (12) extends substantially perpendicularly upwards from the base plate (16), and a support web (18) extends at an angle from a rear face of the barrier wall (14) to an upper surface of the base plate (16). In use, when rock fill is dumped onto the rear of the bund modules (12), and allowed to flow back to its
(Continued)

natural angle of repose behind the barrier walls (14), it creates a rock bund (20) with a front face formed by the extended barrier wall (14).

19 Claims, 2 Drawing Sheets

(52) U.S. Cl.
CPC .. *E02D 2200/1642* (2013.01); *E02D 2220/00* (2013.01); *E02D 2300/00* (2013.01); *E02D 2300/0017* (2013.01); *E02D 2600/30* (2013.01)

(58) Field of Classification Search
CPC ..... E02D 2300/0017; E02D 2600/30; E02D 17/18; E02D 17/20; E02B 3/106
USPC ..... 405/16, 19, 20, 33, 34, 272, 284, 286, 405/302.6
See application file for complete search history.

(56) References Cited

U.S. PATENT DOCUMENTS 3,426,541 A * 2/1969 Chiaves ..... E02D 29/0266 405/287
3,977,199 A 8/1976 Chiaves
4,000,622 A * 1/1977 Chiaves ..... E02D 29/0266 405/286
4,668,129 A * 5/1987 Babcock ..... E01B 2/00 405/284
5,468,098 A 11/1995 Babcock
5,605,413 A * 2/1997 Brown ..... E01F 15/025 256/13.1
5,669,737 A * 9/1997 Equilbec ..... E02D 29/0225 405/262
5,921,709 A * 7/1999 Baum ..... E02B 13/02 405/114
7,494,112 B2 * 2/2009 Fromm ..... E01F 13/12 256/64
8,545,126 B1 * 10/2013 Alsaffar ..... E01F 15/086 256/13.1
2009/0223121 A1 * 9/2009 Jones ..... A01G 1/08 47/33
2013/0071188 A1 * 3/2013 Taylor ..... E02B 7/20 405/114

FOREIGN PATENT DOCUMENTS

| | | |
|---|---|---|
| KR | 20110114040 | 10/2011 |
| KR | 20120011175 | 2/2012 |
| RU | 2228993 | 5/2004 |
| RU | 2291243 | 1/2007 |
| RU | 70522 | 1/2008 |
| SU | 1788151 | 1/1993 |

OTHER PUBLICATIONS

Australian International-Type Search report issued in National Application No. 2014903228, dated Sep. 4, 2014, 7 pages.
Office Action and Search Report issued in corresponding Russian Application No. 2017103301, dated Nov. 19, 2018, 6 pages.

* cited by examiner

EDGE PROTECTION SAFETY BUND SYSTEM

FIELD OF THE INVENTION

The present invention relates to a safety bund system to provide improved edge protection where a rock berm or safety bund is employed and relates particularly, although not exclusively, to such an edge protection safety bund system for a haulage road or ramp in an open-pit mine.

BACKGROUND TO THE INVENTION

In open-pit mining large haul trucks and other vehicles are used to transport the ore from the bottom of the pit to the surface. A low incline haulage road is employed on the pit wall to enable the vehicles to travel up out and down into the pit. An important safety feature of the haulage road is the provision of a safety bund or rock berm to prevent vehicles from accidentally leaving the road, either due to driver inattention, poor visibility or brake failure. Such rock bunds are also employed along pit ramp edges. Typically a safety bund is employed that consists of dirt and rock piled along the edge of the haulage road or pit ramp. Government regulations typically require the safety bund to be at least half the height of the wheels of the largest mining machine on-site.

There are several disadvantages of rock bunds. There is always the danger that a fully-loaded runaway truck will simply ride up and over, or crash through, the rock bund when travelling at high speed. This is because the incline of the sides of the rock bund, as defined by the angle of repose of the dirt and rock used to make it, may be relatively shallow. There is a further disadvantage due to the fact that the rock bund occupies a substantial area along the edge of the road or ramp, which reduces the width of the road or ramp and/or increases the total width of the land that has to be set aside for the road or ramp. This represents 'wasted' space, which is economically valuable; if some of this wastage can be eliminated by reducing the footprint of the safety bund it will result in significant savings.

The present invention was developed with a view to providing an edge protection safety bund system that improves the effectiveness of a rock bund in an open-pit mine. Although the following description of the edge protection safety bund system will be given primarily with reference to its application in an open-pit mine, it will be apparent that it may also have wider applications.

References to prior art in this specification are provided for illustrative purposes only and are not to be taken as an admission that such prior art is part of the common general knowledge in Australia or elsewhere.

SUMMARY OF THE INVENTION

According to one aspect of the present invention there is provided an edge protection safety bund system for use in connection with a rock bund made of rock fill, the safety bund system comprising:

a bund module having a barrier wall and a base plate, the barrier wall extending substantially perpendicularly upwards from the base plate, and a support web extending at an angle from a rear face of the barrier wall to an upper surface of the base plate wherein, in use, when rock fill is dumped onto the rear of the bund module and allowed to flow back to its natural angle of repose behind the barrier wall it creates a rock bund with a front face formed by the barrier wall.

Preferably the bund module is one of a plurality of bund modules arranged side by side to form an extended barrier wall. Advantageously a plurality of the bund modules is connected together so that they effectively act together in the event of a heavy vehicle impact. Typically the bund modules are connected together with a flexible elongate member. Typically the flexible elongate member is a rope or cable provided along the rear face of the barrier wall. Preferably the barrier wall of each bund module is designed to overlap with the barrier wall of an adjacent module wherein, in use, the rock fill is inhibited from coming through any gaps between the modules. Preferably each vertical edge of the barrier wall is formed with an overlap region having rounded edges which mate with a matching overlap region on an adjacent module.

Advantageously the support web is wedge-shaped in transverse cross-section, with a narrowest point of the web being closest to the rear face of the barrier wall. Preferably the support web is provided with a gap between the web and the rear face of the barrier wall and the upper surface of the base plate.

Preferably the barrier wall, base plate and support web of each bund module is formed as a single integral structure, typically by moulding. Advantageously the bund module further comprises a substantially hollow shell, a front wall of the hollow shell forming a front face of the barrier wall. Preferably the substantially hollow shell is filled with a suitable filler material. Typically the shell of the bund module is manufactured from a suitably rigid moulded plastics material, for example, a rota-moulded thermoplastic material. Advantageously the plastics material is a brightly coloured, high-visibility plastics material.

Preferably the barrier wall of the bund module is designed to have a height at least as high as the axle height of the largest open pit haul truck.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWINGS

The nature of the invention will be better understood from the following detailed description of a specific embodiment of the edge protection safety bund system, given by way of example only, with reference to the accompanying drawings, in which.

DETAILED DESCRIPTION OF PREFERRED EMBODIMENTS

Figure 1B:
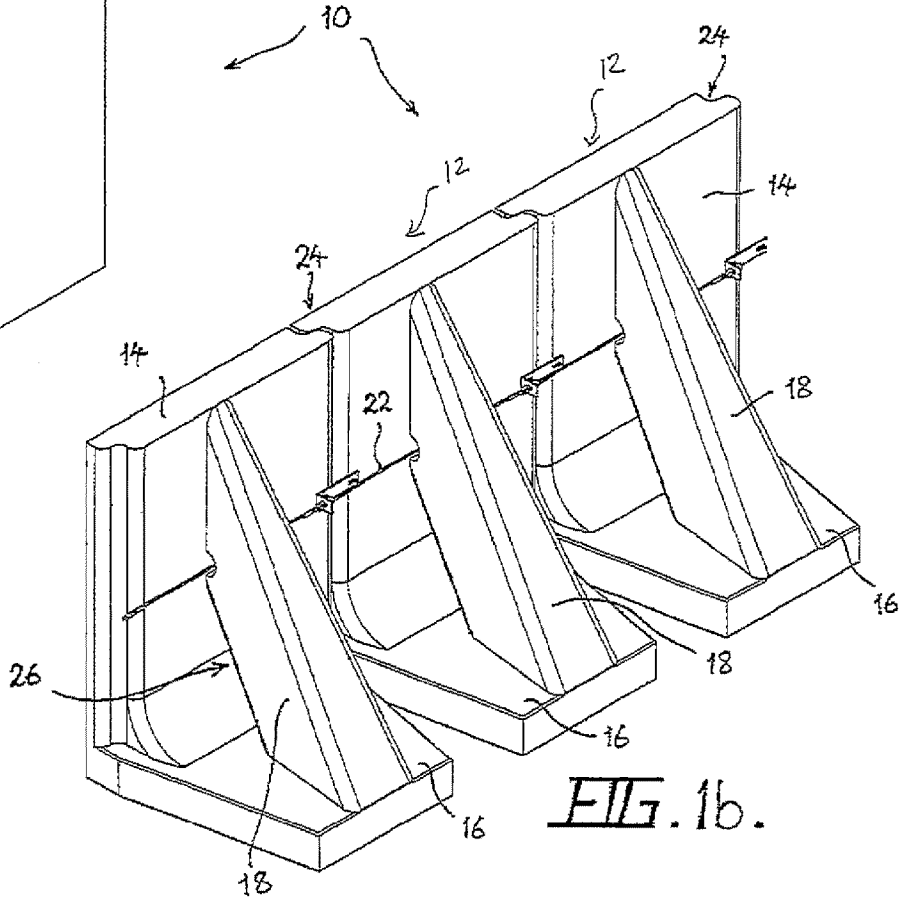
FIGS. 1*a* and 1*b* are a front and rear perspective view respectively of a preferred embodiment of the edge protection safety bund system according to the present invention; and, FIG. 2 is a side elevation of the edge protection safety bund system of FIG. 1 shown in situ with a rock bund.
Figure 1A:
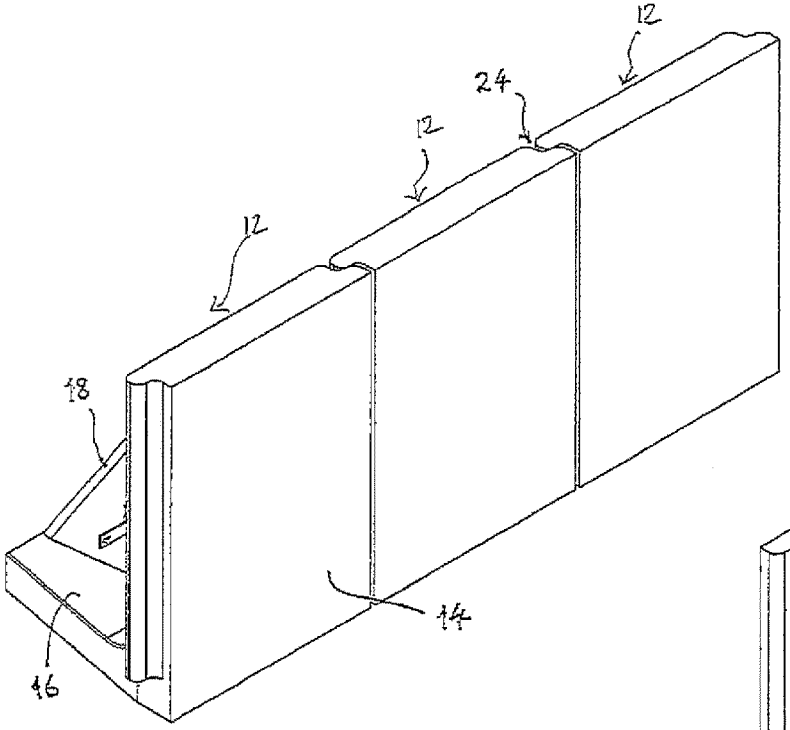
Figure 2:
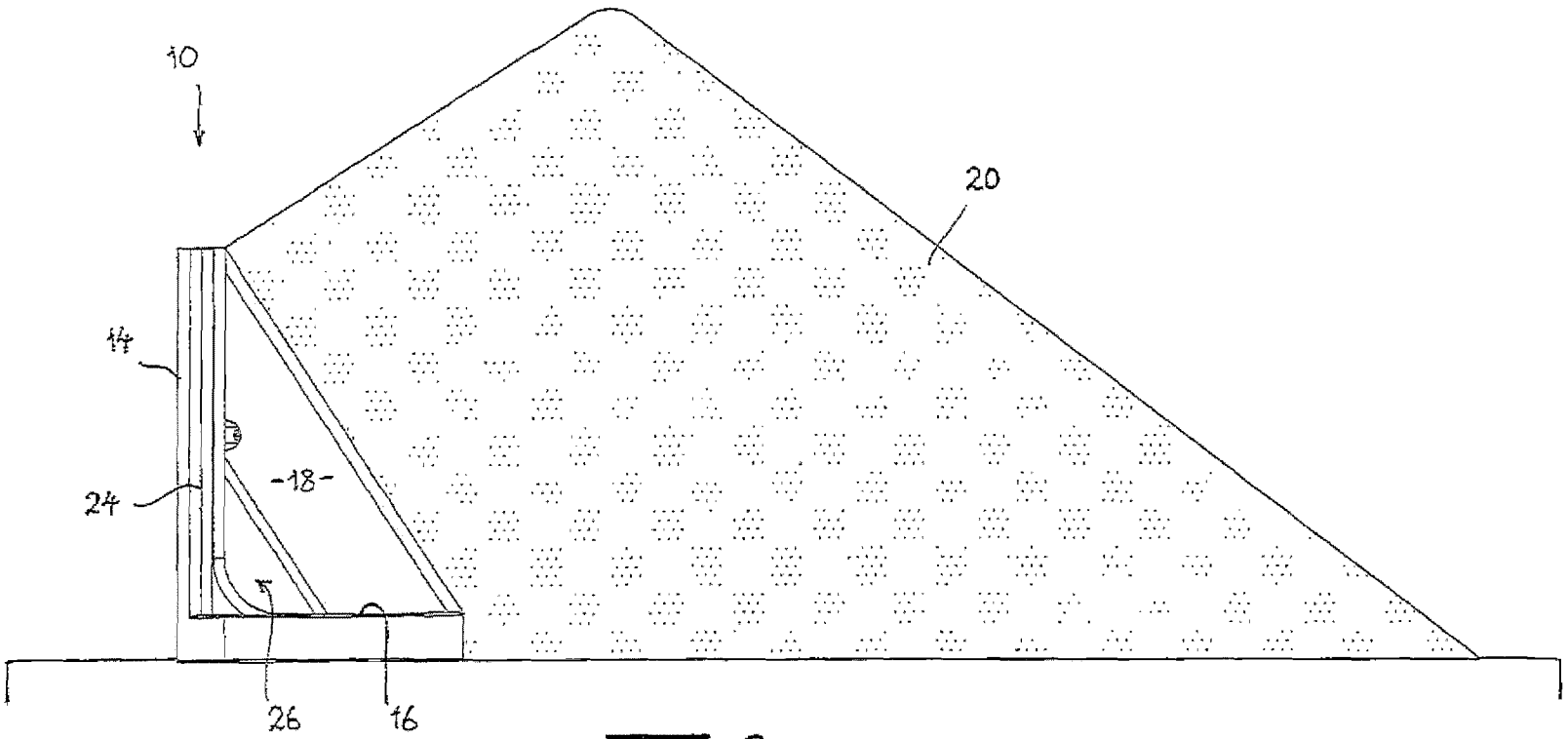

A preferred embodiment of an edge protection safety bund system 10 in accordance with the invention for use in connection with a rock bund made of rock fill is illustrated in FIGS. 1 and 2. The edge protection safety bund system 10 typically comprises a bund module 12 having a barrier wall 14 and a base plate 16. As shown in FIG. 1, the bund module 12 is preferably one of a plurality of bund modules 12 arranged side by side to form an extended barrier wall. The barrier wall 14 of each module 12 extends substantially perpendicularly upwards from the base plate 16, and a support web 18 extends at an angle from a rear face of the barrier wall 14 to an upper surface of the base plate 16. In use, when rock fill is dumped onto the rear of the bund modules 12, and allowed to flow back to its natural angle of repose behind the barrier walls 14 as shown in FIG. 2, it creates a rock bund 20 with a front face formed by the extended barrier wall 14.

Advantageously a plurality of the bund modules 12 is connected together so that they effectively act together as a unit in the event of a heavy vehicle impact. Typically the plurality of bund modules 12 is connected together with a flexible elongate member, such as a rope or cable 22, provided along the rear face of the barrier wall 14, as shown in FIG. 1*b*. Any number of the modules 12 may be connected together in this manner. Typically four or five of the bund modules 12 are connected together with a single rope or cable. In the event of heavy vehicle impact the vehicle will have to push the connected plurality of modules 12 together through the mass of rock. This means a much larger volume of rock has to be mobilised in order to allow the vehicle to push through the rock bund 20.

Preferably the barrier wall 14 of each bund module 12 is designed to overlap with the barrier wall 12 of an adjacent module 12 wherein, in use, the rock fill is inhibited from coming through any gaps between the modules 12. As can be seen in FIG. 1, each vertical edge of the barrier wall 14 is formed with an overlap region 24, having rounded edges which mate with a matching overlap region 24 on an adjacent module 12.

Advantageously the support web 18 is wedge-shaped with a narrowest point of the web 18 being closest to the rear face of the barrier wall 14. Preferably the support web 18 is formed with a gap 26 between the web 18 and the rear face of the barrier wall 14 and the upper surface of the base plate 16. The reverse wedge shape of the support web 18 of each bund module 12, in conjunction with the gap 26 between the webbing and the rear face and base plate, will counteract any rotational forces on the bund module 12 generated by the weight of rock on the barrier wall 14 using frictional forces within the rock fill mass of the rock bund 20.

Preferably the barrier wall 14, base plate 16 and support web 18 of each module 12 are formed as a single integral structure, typically by moulding. Advantageously the bund module 12 further comprises a substantially hollow shell, a front wall of the hollow shell forming a front face of the barrier wall 14. The hollow shell is preferably filled with a suitable filler material. Typically the shell of the bund module is manufactured from a suitably rigid moulded plastics material, for example, a rota-moulded thermoplastic material. Advantageously the plastics material is a brightly coloured, high-visibility plastics material. The plastics material may also include internal steel (or other material) reinforcement. Preferably the filler material is a rigid fill media such as foamed grout or concrete. The bund modules 12 may also be manufactured entirely from concrete.

Preferably the barrier wall 14 of the bund modules 12 is designed to have a height at least as high as the axle height of the largest open pit haul truck.

The edge protection safety bund system 10 is designed to act as a cantilever wall to create more effective rock bunding along pit walls and pit ramp edges. The bund modules 12 will typically be positioned in a line adjacent to the edge of a pit wall or pit ramp. Once in position rock fill will be dumped onto the rear side of the bund modules and allowed to flow back to the natural angle of repose, creating rock bunds of sufficient height for the particular sites' requirements.

The completed wall of bund modules 12 with rock behind it will be a much more effective barrier for several reasons. Firstly the extended barrier wall 14 will be close to vertical up to a height above the axle height of the largest open pit dump truck. This will ensure that impact forces are imparted through the safety bund system 10 and into the rock horizontally. This contrasts with a normal rock bund which is angled at the natural angle of repose of the rock (not normally higher than 45°). In fact the apparent angle of a rock bund, when a truck is coming down a pit ramp and hitting the bund on an acute angle can be quite low, and therefore it is relatively easy for a large truck tyre to drive up the bund. This means that the rock has to do work on the underside of the truck as it goes over the rock bund. In the case of an acute angle collision the tyre will be deflected back into the ramp. With an impact closer to perpendicular to the line of the barrier wall 14, the bund modules 12 will work together and the truck will have to push the modules as a unit through the mass of rock. This means a much larger volume of rock has to be mobilised in order to allow the truck to push through the bund, than would otherwise be the case if it drove partially up or into a conventional rock bund.

A further benefit of the edge protection safety bund system 10 is that it will reduce the footprint required to provide sufficient edge protection for heavy equipment. This means mines can be redesigned to have narrower in pit ramps which results in potentially very significant economic benefits to the operation. One of the problems with rock bunds on open pit roads is that they can often be used as 'borrow' by grader operators working to maintain the road surface. This means the effective width of the rock bund can be eroded away over time without anyone noticing.

The use of high visibility bund modules 12 will result in users of the road feeling safer, and will better delineate roadways in times of low visibility such as night time or during foggy conditions.

Now that a preferred embodiment of the edge protection safety bund system has been described in detail, it will be apparent that the described embodiment provides a number of advantages over the prior art, including the following:

(i) It improves the effectiveness of a conventional rock bund by creating a barrier wall that is substantially vertical;

(ii) By connecting a plurality of the bund modules together it increases the volume of rock that effectively acts as a barrier during a heavy vehicle impact;

(iii) The bund modules are relatively light-weight and easy to install, and their high visibility further enhances road safety.

(iv) The safety bund system reduces the footprint of the rock bund, providing further economic benefits.

It will be readily apparent to persons skilled in the relevant arts that various modifications and improvements may be made to the foregoing embodiments, in addition to those already described, without departing from the basic inventive concepts of the present invention. For example, the shape and configuration of the bund module may depart significantly from that of the illustrated embodiment, without in any way altering the effective functioning of the module. Therefore, it will be appreciated that the scope of the invention is not limited to the specific embodiments described.

The invention claimed is:

1. An edge protection vehicle safety bund system at an edge of a road or a ramp, the vehicle safety bund system comprising:

a bund module disposed at the edge of the road or ramp, the bund module having a barrier wall and a base plate, the barrier wall extending vertically and perpendicularly upwards from the base plate, and a support web extending at an angle from a rear face of the barrier wall to an upper surface of the base plate, wherein the support web has opposing side walls and an end wall, the side walls are spaced inward from ends of the barrier wall and inward from ends of the base plate, a distance between the side walls tapers from the base plate to the rear face of the barrier wall, a distance between the end wall and the rear face of the barrier wall tapers from the base plate to the rear face of the barrier wall, and the end wall is linear from the base plate to the rear face of the barrier wall, wherein the barrier wall, base plate and support web of the bund module are moulded from plastics material as a single integrally formed hollow structure; and, rock fill dumped onto the rear of the bund module and allowed to flow back to its natural angle of repose behind the barrier wall to create a rock bund with a vertical front face formed by the barrier wall so that an impact of a truck crashing into the front face of the rock bund will be imparted through the safety bund system and into the rock fill horizontally and therefore the rock fill will more effectively inhibit the truck from pushing through the rock bund.

2. The edge protection vehicle safety bund system as defined in claim 1, comprising a plurality of the bund modules arranged side by side to form an extended barrier wall, and the rock fill is dumped onto the rear of each of the bund modules.

3. The edge protection vehicle safety bund system as defined in claim 2, wherein the plurality of the bund modules are connected together so that they effectively act together in the event of a heavy vehicle impact.

4. The edge protection vehicle safety bund system as defined in claim 3, wherein the bund modules are connected together with a flexible elongate member.

5. The edge protection vehicle safety bund system as defined in claim 4, wherein the flexible elongate member is a rope or cable provided along each rear face of each barrier wall among the plurality of bund modules.

6. The edge protection vehicle safety bund system as defined in claim 4, wherein the support web of each bund module includes an opening, and the flexible elongate member passes through the opening of the support web of each bund module among the plurality of bund modules, and the support web further includes a gap between the support web and the rear face of the barrier wall and the upper surface of the base plate.

7. The edge protection vehicle safety bund system as defined in claim 2, wherein the barrier wall of each bund module is designed to overlap with the barrier wall of an adjacent bund module wherein the rock fill is inhibited from coming through any gaps between the bund modules.

8. The edge protection vehicle safety bund system as defined in claim 7, wherein the barrier wall of each bund module among the plurality of bund modules includes a vertical edge, and each vertical edge is formed with an overlap region having rounded edges which mate with a matching overlap region on an adjacent bund module.

9. The edge protection vehicle safety bund system as defined in claim 1, wherein the support web is provided with a gap between the support web and the rear face of the barrier wall and the upper surface of the base plate.

10. The edge protection vehicle safety bund system as defined in claim 1, wherein the barrier wall comprises a hollow shell, a front wall of the hollow shell forming the vertical front face of the barrier wall.

11. The edge protection vehicle safety bund system as defined in claim 10, wherein the hollow shell is filled with a suitable filler material.

12. The edge protection vehicle safety bund system as defined in claim 10, wherein the hollow shell is manufactured from a suitably rigid moulded plastics material.

13. The edge protection vehicle safety bund system as defined in claim 12, wherein the plastics material is a brightly coloured, high-visibility plastics material.

14. The edge protection vehicle safety bund system as defined in claim 1, wherein the barrier wall has a height at least as high as an axle height of an open pit haul truck.

15. The edge protection vehicle safety bund system as defined in claim 1, wherein the end wall of the support web intersects a rear edge of the base plate and intersects a top edge of the barrier wall.

16. The edge protection vehicle safety bund system as defined in claim 1, wherein the bund module includes a gap between the rear face of the barrier wall and the support web.

17. The edge protection vehicle safety bund system as defined in claim 1, further comprising a chamfer between the end wall and one of the side walls, and the bund module includes a single one of the support webs.

18. An edge protection vehicle safety bund system, the vehicle safety bund system comprising:

a bund module having a barrier wall and a base plate, wherein the base plate includes a front edge and a rear edge, and the barrier wall extends vertically and perpendicularly upwards from the front edge of the base plate, and a support web extends at an angle from a rear face of the barrier wall to an upper surface of the base plate, wherein the support web has opposing side walls and an end wall, a distance between the side walls tapering from the base plate to the rear face of the barrier wall, a distance between the end wall and the rear face of the barrier wall tapers the base plate to the rear face of the barrier wall, and the end wall is linear from the base plate to the rear face of the barrier wall, wherein the barrier wall, base plate and support web of the bund module is moulded from plastics material as a single integrally formed hollow structure and wherein, in use, when rock fill is dumped onto the rear of the bund module and allowed to flow back to its natural angle of repose behind the barrier wall it creates a rock bund with a vertical front face formed by the barrier wall so that an impact of a truck crashing into the front face of the rock bund will be imparted through the safety bund system and into the rock fill horizontally and therefore the rock fill will more effectively inhibit the truck from pushing through the rock bund.

19. The edge protection vehicle safety bund system as defined in claim 18, further comprising a chamfer between the end wall and one of the side walls, and the bund module includes a single one of the support webs.

* * * * *